US005286127A

United States Patent [19]

Scholz

[11] Patent Number: 5,286,127

[45] Date of Patent: Feb. 15, 1994

[54] WRITING INSTRUMENT

[75] Inventor: Günter Scholz, Garbsen, Fed. Rep. of Germany

[73] Assignee: Pelikan Akteingesellschaft, Hanover, Fed. Rep. of Germany

[21] Appl. No.: 975,358

[22] Filed: Nov. 16, 1992

[30] Foreign Application Priority Data

Nov. 16, 1991 [DE] Fed. Rep. of Germany ..... 4137838

[51] Int. Cl.[5] ..... B43K 8/02; B43K 8/08; B43K 8/12

[52] U.S. Cl. ..... 401/199; 401/198

[58] Field of Search ..... 401/199, 198

[56] References Cited

U.S. PATENT DOCUMENTS 3,003,181 10/1961 Rosenthal ..... 401/199
3,141,187 7/1964 Simon, Jr. et al. ..... 401/199
3,345,674 10/1967 De Groft ..... 401/198
3,969,027 7/1976 Randar et al. .
4,583,875 4/1986 Manusch et al. .

FOREIGN PATENT DOCUMENTS 649871 11/1967 Fed. Rep. of Germany ..... 401/198
2319942 10/1974 Fed. Rep. of Germany .
2456905 6/1975 Fed. Rep. of Germany .
2555391 11/1976 Fed. Rep. of Germany ..... 401/199
3504462 8/1986 Fed. Rep. of Germany ..... 401/199
8505344 12/1985 World Int. Prop. O. ..... 401/99

*Primary Examiner*—Steven A. Bratlie
*Attorney, Agent, or Firm*—Herbert Dubno; Andrew Wilford

[57] ABSTRACT

A writing instrument has an elongated hollow barrel having a front end formed with a longitudinally extending tip passage centered on and defining an axis, an ink reservoir in the barrel, and a rigid synthetic-resin tip extending along the axis, formed with longitudinal capillaries, and having a front pointed end which projects axially forwardly from the barrel and a rear pointed end which is in the reservoir. This tip is centrally formed with a radially outwardly open groove having axially spaced front and rear flanks and is substantially symmetrical about a plane bisecting the groove. A plurality of radially inwardly projecting holding ribs formed in the passage radially engage the tip and each form a forwardly directed shoulder bearing axially forward on the front flank of the groove.

12 Claims, 1 Drawing Sheet

WRITING INSTRUMENT

FIELD OF THE INVENTION

The present invention relates to a writing instrument. More particularly this invention concerns a pen having a tip formed by a rigid synthetic-resin rod formed with longitudinal capillaries and a method of making such a pen.

BACKGROUND OF THE INVENTION

A writing instrument such as described in German patent documents 2,319,942 of G. Edel and 2,456,905 of N. Otake et al has an elongated hollow barrel having a front end formed with a longitudinally extending tip passage centered on and defining an axis and provided internally with an ink reservoir. A rigid synthetic-resin tip extending along the axis and formed with longitudinal capillaries has a front pointed end which projects axially forwardly from the barrel and a rear end which is in the reservoir. The tip projects axially forwardly from the barrel so that ink in the reservoir can be drawn through the tip's capillaries to its front end and there transferred to a writing surface.

In order to retain the tip in place the barrel may be formed as described in the above-cited Otake reference with a bump projecting radially inward into the passage so as to engage the tip and retain it in a force fit. Such a formation does not hold the tip solidly enough, so that a strong rearwardly directed blow to the tip can actually drive it backward into the barrel. The above-cited Edel reference proposes forming the tip asymmetrically with a radially outwardly open groove that is of increasing depth toward one end of the tip. Radially inwardly projecting ribs in the passage engage in this groove, providing a fairly good hold. Nonetheless in this arrangement the use of an asymmetrical tip makes manufacturing the pen somewhat more complex in that a separate device must be provided to properly orient the tips before they are inserted into the barrels. Similarly U.S. Pat. No. 3,969,027 of G. Randar proposes another asymmetrical tip having a radially outwardly open groove that snap fits with a radially inwardly projecting collar in the front end of the passage. Once again, the asymmetry of the tip complicates assembly of the pen, and fabrication of the tip is made more complex by the necessity of making it of smaller diameter rearward of the groove.

OBJECTS OF THE INVENTION

It is therefore an object of the present invention to provide an improved writing instrument.

Another object is the provision of such an improved writing instrument which overcomes the above-given disadvantages, that is which is easy to manufacture, whose tip is of simple construction, and which can nonetheless stand up to hard use.

A further object is to provide an improved method of making such a pen.

SUMMARY OF THE INVENTION

A writing instrument has according to the invention an elongated hollow barrel having a front end formed with a longitudinally extending tip passage centered on and defining an axis, an ink reservoir in the barrel, and a rigid synthetic-resin tip extending along the axis, formed with longitudinal capillaries, and having a front pointed end which projects axially forwardly from the barrel and a rear pointed end which is in the reservoir. This tip is centrally formed with a radially outwardly open groove having axially spaced front and rear flanks and is substantially symmetrical about a plane bisecting the groove. A plurality of radially inwardly projecting holding ribs formed in the passage radially engage the tip and each form a forwardly directed shoulder bearing axially forward on the front flank of the groove.

Thus the tip according to this invention is completely symmetrical so that it can be inserted in the barrel without having to orient it in one axial direction or the other, greatly facilitating automated manufacture of the pen. In addition the plastic deformation of the holding ribs ensures that the tip will be solidly mounted and will not move during normal use.

According to another feature of the invention the groove is formed of groove sections with a central annular bulge in the groove centered on the plane and spaced axially rearward of the front flank and forward of the rear flank. The annular bulge has end flanks that extend at an acute angle to the axis. Thus even a relatively long tip can be installed easily.

Normally according to the invention the groove flanks are substantially perpendicular to the axis and each have a sharp radial outer edge that bites into the holding ribs on assembly of the pen.

The passage in accordance with this invention has a predetermined axial length and front and rear ends. The holding ribs each have an axial length substantially shorter than the passage length and is located at the rear passage end. Each holding rib has a front edge inclined at an acute angle to the axis.

For best gripping of the tip, the barrel is further formed in the passage between the holding ribs with guide ridges interleaved with the holding ribs. The passage has a predetermined axial length and front and rear ends and the holding ribs each have an axial length substantially shorter than the passage length and are each located at the rear passage end. The guide ribs extend substantially the full length of the passage and are substantially longer than the holding ribs. These guide ribs are radially shorter than the holding ribs. The spaces between the guide and holding ribs form axially open bleed or vent passages.

BRIEF DESCRIPTION OF THE DRAWING

The above and other objects, features, and advantages will become more readily apparent from the following, reference being made to the accompanying drawing in which.

SPECIFIC DESCRIPTION

Figure 1:
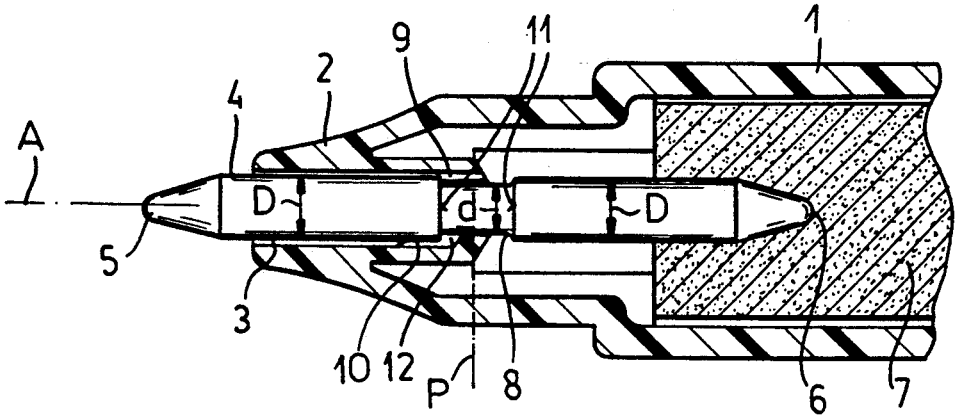
FIG. 1 is an axial section through the front end of a writing instrument according to the invention.

As seen in FIG. 1 a pen according to the invention has a tubular barrel 1 centered on an axis A and having a front end 2 formed with a cylindrical coaxial passage 3. A tip 4 formed of a rigid synthetic resin and having longitudinal capillaries extends coaxially through the passage 3 and has a front end 5 protecting forward from the barrel 1 and a rear end 6 engaged in a reservoir 7 comprised of a porous ink-saturated body.

According to the invention the tip 4 is symmetrical to a plane P perpendicular to the axis A and is formed centrally with a radially outwardly open groove 8 defined between flanks or shoulders 11 extending in respective planes perpendicular to the axis A and equispacedly flanking the symmetry plane P. The tip 4 is cylindrical to each side of the groove 8 and has a relatively large diameter D while in the groove 8 it is also cylindrical, but with a smaller diameter d.

In addition in accordance with this invention the barrel 1 is formed in the passage 3 with an array of axially extending, angularly equispaced, radially inwardly projecting, and relatively long guide ribs 9 that extend the full length of the passage 3, from its extreme front end to its extreme rear end. These ribs 9 resiliently engage the front portion of the tip 4 and maintain it solidly radially in place in the barrel 1. In addition the passage 3 is formed at its rear end with plurality of axially extending, angularly equispaced, radially inwardly projecting, and relatively short holding ribs 10 each extending about one-third the length of the passage 3.

The tip 4 is installed in the barrel by being pushed axially backward (from left to right in the drawing) in the passage 3. This causes the tip 4 to slide on the guide ribs 9. Once, however, the front flank 11 comes level with the shorter holding ribs 10, however, this flank 11 bites into them, plastically deforming them and forming in each such rib 10 a forwardly and inwardly directed right-angle step or shoulder 12 that fits perfectly to the front flank 11. Thus once the rear end 6 is seated in the reservoir 7, the rib shoulders 12 solidly engage the tip 4 at its groove 8, thereby retaining it in position. The force used to insert the tip 4 into the passage 3 is much greater than normal writing force, so that, once the ribs 10 are permanently deformed as described immediately above, the tip 4 will not be pushed back further into the barrel 1 during normal use.

Figure 2:
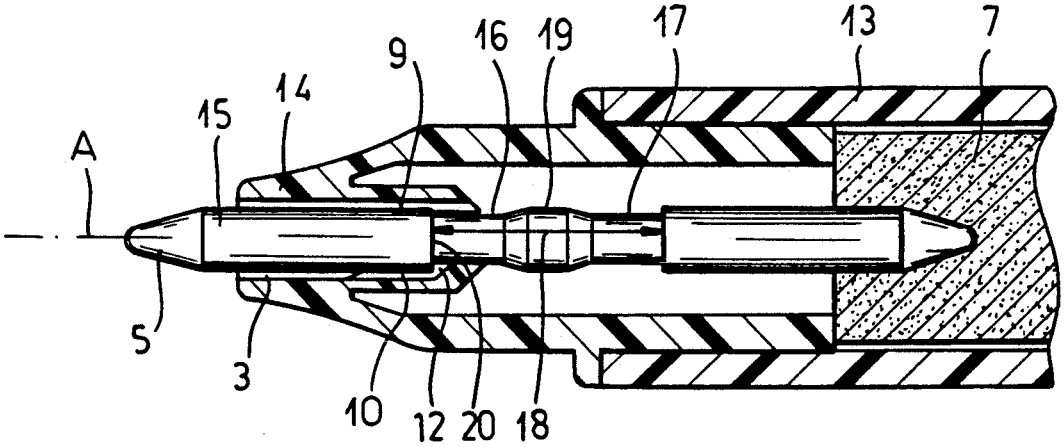
FIG. 2 is a view like FIG. 1 of another pen in accordance with this invention .

In the arrangement of FIG. 2 the barrel is formed by a rear sleeve 13 and a front tip holder 14 that together have a shape generally identical to that of the barrel 1 of FIG. 1. Here a tip 15 is used which has ends identical to those of FIG. 1, but a central groove 16 of relatively long length 18 and formed with a central bulge 19 having angled flanks. This device works identically to that of FIG. 1, with the front flank 20 forming shoulders 12 in the ribs 10 as the tip is inserted into the barrel 13, 14.

I claim:

1. A writing instrument comprising:

an elongated hollow barrel having a front end formed with a longitudinally extending tip passage centered on and defining an axis;

an ink reservoir in the barrel;

a rigid and mainly cylindrical synthetic-resin tip extending along and centered can the axis, formed with longitudinal capillaries, having a front pointed end which is centered on the axis and projects axially forwardly from the barrel and a rear pointed end which is centered on the axis and in the reservoir, and centrally formed with a radially outwardly open groove having axially spaced and axially confronting front and rear flanks, the tip being substantially symmetrical about a plane bisecting the groove and substantially perpendicular of the axis; and a plurality of radially inwardly projecting and axially elongated holding ribs formed in the passage, radially engaging the tip, angularly spaced about the axis, and each forming an axially forwardly directed shoulder bearing axially forward on the front flank of the groove.

2. The writing instrument defined in claim 1 wherein the groove is formed of groove sections flanking a radially outwardly projecting central annular bulge in the groove centered on the plane and spaced axially rearward of the front flank and forward of the rear flank.

3. The writing instrument defined in claim 2 wherein the annular bulge has end flanks that extend at an acute angle to the axis.

4. The writing instrument defined in claim 1 wherein the flanks are substantially perpendicular to the axis.

5. The writing instrument defined in claim 4 wherein each flank has a sharp radial outer edge.

6. The writing instrument defined in claim 1 wherein the passage has a predetermined axial length and front and rear ends, the ribs each having an axial length substantially shorter than the passage length and being located at the rear passage end.

7. The writing instrument defined in claim 6 wherein each rib has a front edge inclined at an acute angle to the axis.

8. The writing instrument defined in claim 1 wherein each rib has a front edge inclined at an acute angle to the axis.

9. The writing instrument defined in claim 1 wherein the barrel is further formed in the passage between the holding ribs with guide ridges interleaved with the holding ribs.

10. The writing instrument defined in claim 9 wherein the passage has a predetermined axial length and front and rear ends, the holding ribs each having an axial length substantially shorter than the passage length and being located at the rear passage end, the guide ribs extending substantially the full length of the passage and being substantially longer than the holding ribs.

11. The writing instrument defined in claim 10 wherein the guide ribs are radially shorter than the holding ribs.

12. A method of making a writing instrument comprised of an elongated hollow barrel having a front end formed with a longitudinally extending tip passage centered on and defining an axis;

an ink reservoir in the barrel;

a rigid and mainly cylindrical synthetic-resin tip extending along and centered on the axis, formed with longitudinal capillaries, having a front pointed end centered on the axis and a rear pointed end also centered on the axis, and centrally formed with a radially outwardly open groove having axially spaced and axially confronting front and rear flanks, the tip being substantially symmetrical about a plane bisecting the groove and substantially perpendicular to the axis; and a plurality of radially inwardly projecting and axially elongated holding ribs formed in the passage spaced angularly about the axis, the method comprising the steps of:

pushing the tip axially backward into the passage until the front end projects axially forwardly from the barrel and the rear end is in the reservoir with a force substantially greater than a normal axially backward writing force such that the front flank deforms the holding ribs and forms in each holding rib an axially forwardly directed shoulder bearing axially forward on the front flank of the groove.

* * * * *